US007062946B2

(12) United States Patent
Palzer

(10) Patent No.: US 7,062,946 B2
(45) Date of Patent: Jun. 20, 2006

(54) GUIDE ROLLER SYSTEM FOR GUIDING THE RODS BETWEEN THE FINISHING STANDS OF ROD ROLLING MILLS

(75) Inventor: Otmar Palzer, Niederrieden (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/489,133

(22) PCT Filed: Aug. 21, 2002

(86) PCT No.: PCT/EP02/09334

§ 371 (c)(1),
(2), (4) Date: Jun. 2, 2004

(87) PCT Pub. No.: WO03/022473

PCT Pub. Date: Mar. 20, 2003

(65) Prior Publication Data

US 2004/0244678 A1 Dec. 9, 2004

(30) Foreign Application Priority Data

Sep. 6, 2001 (DE) ..... 101 43 617

(51) Int. Cl.
*B21B 39/20* (2006.01)

(52) U.S. Cl. ..... 72/250; 72/428

(58) Field of Classification Search ..... 72/250, 72/251, 227, 231, 428, 246, 287, 289; 226/187, 226/190, 191, 194; 242/157 R
See application file for complete search history.

(56) References Cited

U.S. PATENT DOCUMENTS

| | | | | |
|---|---|---|---|---|
| 4,680,953 | A * | 7/1987 | Fabris | 72/250 |
| 5,412,970 | A | 5/1995 | Kawamura et al. | |
| 5,937,689 | A * | 8/1999 | Fabris | 72/250 |
| 6,209,378 | B1 * | 4/2001 | Bradshaw | 72/250 |

FOREIGN PATENT DOCUMENTS

| | | |
|---|---|---|
| EP | 0 202 377 | 11/1986 |
| JP | 06047424 | 2/1994 |

* cited by examiner

*Primary Examiner*—Derris H. Banks
*Assistant Examiner*—Teresa M Bonk
(74) *Attorney, Agent, or Firm*—Andrew Wilford

(57) ABSTRACT

A roller guide for the guidance of the wire or rod between the finish rolling mill stands of a wire or rod rolling line. The guide has a guide roller pair which are mutually juxtaposed and journaled on free ends of pivot arms of double arm levers. The lever journals are connected with a support body between the finish mill rolls of the rolling line and which has a centering funnel for the rolled wire or rod between the double arm levers. The whereby the pivotal displacements of the pivot arms are settable and spring adjustable about the lever journals. The roller guide is improved in that the pivot arms have setting elements pressed against the support body and in that an adjustable-pressure pneumatic spring connected with the support body and bearing upon the pivot arm extending away from the guide roller or is connected with this pivot arm.

3 Claims, 2 Drawing Sheets

GUIDE ROLLER SYSTEM FOR GUIDING THE RODS BETWEEN THE FINISHING STANDS OF ROD ROLLING MILLS

This application is a national stage of PCT/EP02/09334 filed 21 Aug. 2002 and is based upon German application 101 43 617.3 of 3 Sep. 2001.

FIELD OF THE INVENTION

The invention relates to a roller guide system for guiding the wire or rod between the finish rolling mill stands of a wire or rod rolling line, comprised of a guide roller pair whose guide rollers, which are mutually juxtaposed with one another, are journaled on the free ends of respective pivot arms of double-arm levers, whose lever bearings or fulcra are connected with a support body arranged between the finish rolling mill stands of the rolling line and which has, between the double-arm levers, a centering funnel for the rolled wire or rod, whereby the pivotal displacement of the pivot arms about the lever bearing is spring-adjustable and settable.

BACKGROUND OF THE INVENTION

Guide rolls of this type serve to permit the rolled wire or rod to be fed conveniently into the next pass of the rolling stands downstream of the guide rollers. The guide rollers are thus directed to the center of the pass and are positioned as close as possible to the rolls of the subsequent mill stand since apart from the high speeds with which the wire or rod of modern wire or rod rolling lines traverse the finished mill stands, in this section of the wire or rod rolling line, one must take into consideration narrow pass tolerances. The guide rollers must be able to engage as much as possible without play even oval shaped wire or rod cross sections in this part of the rolling line so as to prevent a tilting or twisting of the wire or rod in the respective pass. This is achieved by a corresponding setting of the pivotal displacement of the pivot arms which carry the guide rollers, usually in the form of double-arm levers which are braced by leaf springs.

The most important drawback of this roller guide arrangement is that with the guide rollers set for a predetermined average cross sectional size of the wire or rod as a consequence of the unavoidable cross sectional variations of the rolled wire or rod which is fed between the rollers, elevated pressure loading of the guide rollers and the rolled wire or rod always arises when the wire cross section exceeds the preset dimensions. In these cases, the guide rollers work mainly as additional rolling elements. As a result, not only do the tolerances of the wire cross section suffer but the bearings of the guide rollers and the guide rollers themselves are loaded beyond the usual magnitudes.

In addition because the guides tend to loosen up, when the rolled wire or rod passing through them has cross sectional dimensions which exceed the set dimensions, there is the danger that the wire will tend to tip or twist in the guide pass. This is especially the case with oval cross sections as to which the tolerances also are poorer. In extreme cases, the rolled wire or rod can become over-rolled.

These problems are increased when the wire or rod is to be dimensionally rolled in accordance with the so-called "free size rolling" system since there the finished cross section of the rolled wire is maintained in a very narrow range and different torque cross sections are rolled in one and the same rolling pass.

OBJECT OF THE INVENTION

The invention has as its object to improve known roller guides so that the wire or rod guidance automatically matches the cross sectional variations which always arise.

SUMMARY OF THE INVENTION

This object is achieved in that on the pivot arms, respectively, between the guide rollers and the lever bearings, there are provided setting elements which are braced against the support body and an adjustable pressure pneumatic spring which is connected with the support body and bears against a pivot arm opposite the pivot arm provided with the guide roller or turned away from the pivot arm provided with the guide roller or connected with this pivot arm.

It is also possible as the invention further foresees, to provide both of the pivot arms turned away from the guide rollers, each with a pneumatic spring braced against the support body.

The pneumatic springs, which, upon displacement of the levers within a fixed range, counteract this displacement or shifting always with constant force and thereby ensure that a rolled wire or rod guide thus equipped can feed different wire or rod cross sections into the rolling pass such that both the rolled wire or rod and also the guide rollers will be impacted always with a constant pressure, independently of the size of the fed cross section. The rolled wire or rod is, as a result of this adapted roller guidance, fed without play and with a constant force, independently of cross sectional variations and does not require, within a certain wire or rod cross sectional range any resetting for each wire cross section, with the consequence that there is a saving in time in rolling mill operations and a corresponding reduction in the operating costs. Apart from the better adherence to tolerances, which results, there is also an increase in the useful life of the guide rollers and their bearings and this contributes to further reduction in cost.

BRIEF DESCRIPTION OF THE DRAWING

The invention is described in greater detail in conjunction with the embodiments shown in the drawing. In the drawing there is shown in.

SPECIFIC DESCRIPTION

Figure 1:
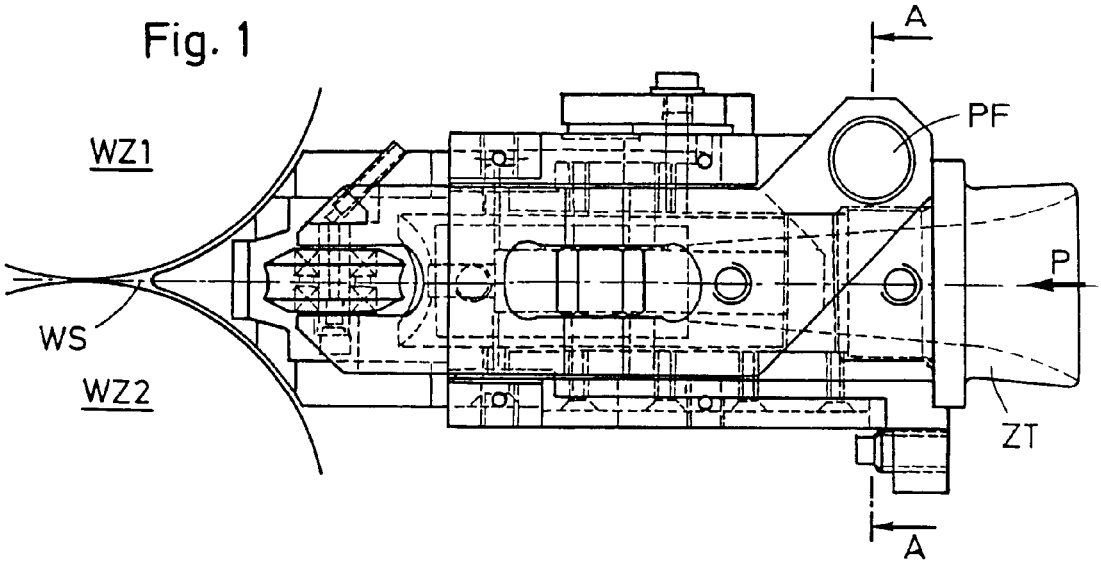
FIG. 1 the elevation of a longitudinal section through the roller guide.
Figure 2:
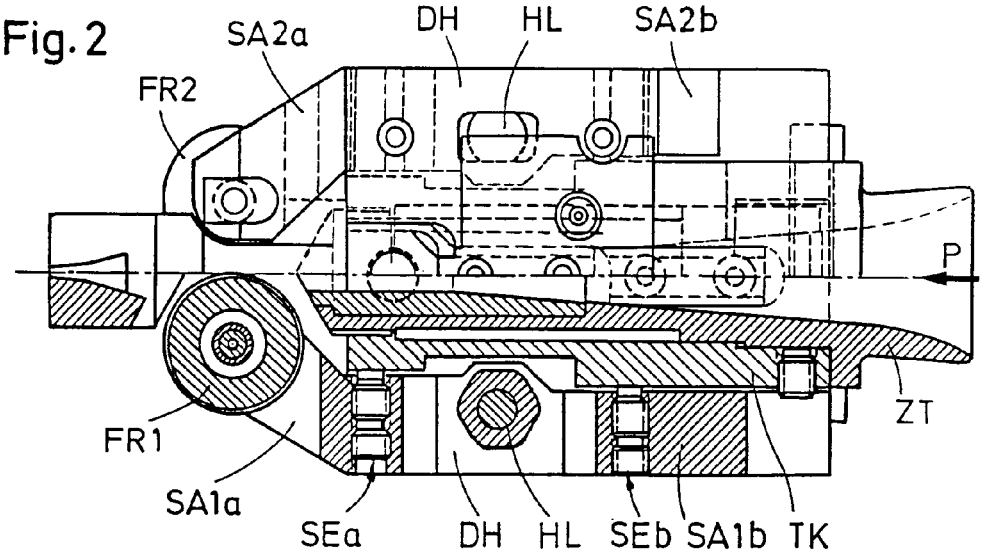
FIG. 2 the plan view of FIG. 1, partly in section.

As can be seen from FIGS. 1 and 2, the roller guide which is located directly ahead of the rolling gap WS formed by the two mill rolls WZ1, WZ2, is comprised of a support body TK which is connected with the rolling mill frame in a manner not shown and which enables the roller guide to be directed to or aligned with this rolling gap WS. On opposite sides of a centering funnel ZT carried by the carrier body and through which a rolled wire or rod, not shown, is fed in the direction of the arrow, are respective double-arm levers DH journaled in respective lever bearings HL. The pivot arms SA1*a* and SA2*a* of the double levers DH which are proximal to the rolls WZ1 and WZ2, carry the two guide rollers FR1 and FR2 and the pivot arms SA1*b* and SA2*b* extending away from the arms carrying these guide rollers have respective setting elements SEa and SEb braced against the support body TK.

On the support body TK there is further (see FIG. 3), above the centering funnel ZT, a pneumatic spring PL with a setting member SG which here bears against the pivot arm SA2*b* extending away from the arm carrying the guide roller FR2. The pneumatic spring PF is fitted in a corresponding receiving opening in the carrier body TK and is secured in it with a clamping device KL.

Figure 3:
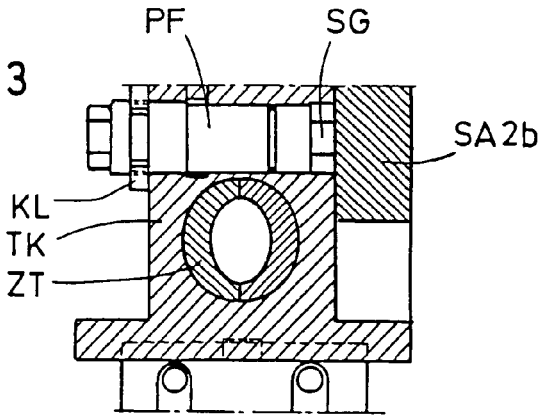
FIG. 3 an elevation of the section taken along the line A—A of FIG. 1.
Figure 4:
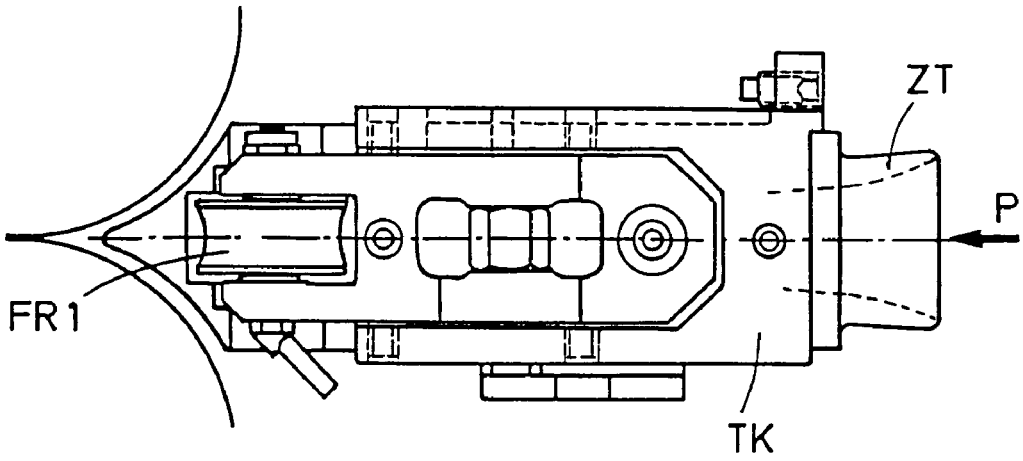
FIG. 4 the elevation of another embodiment of the roller guide.
Figure 5:
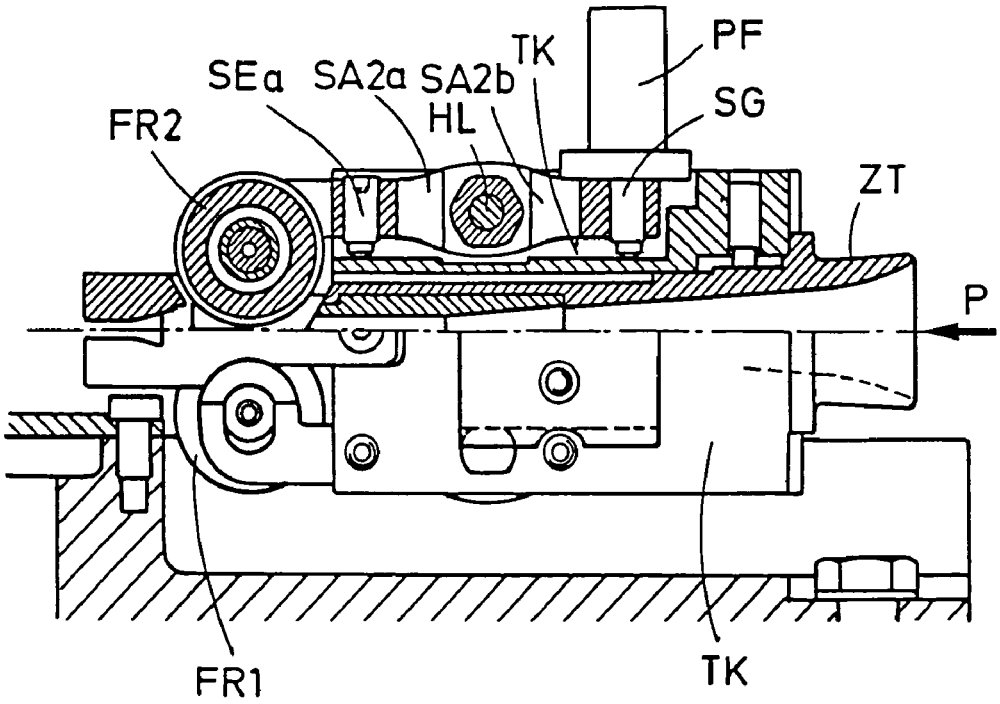
FIG. 5 the plan view of FIG. 4, partly in section.

With the roller guide according to FIGS. 4 and 5 whose configuration corresponds to the configuration according to FIGS. 1–3 except for the arrangement of the pneumatic spring, this pneumatic spring PF is not, as in FIGS. 1–3, connected with the support body TK but rather is mounted on the pivot arm SA2*b* extending away from the arm carrying the guide roller FR2. The setting member SG of the pneumatic spring PF here is braced against the support body TK.

The roller wire or rod, for example with an oval cross section, is fed from the centering funnel ZT through the guide gap formed by the guide rollers FR1 and FR2. This guide gap is set with the aid of setting elements SEa, SEb and indeed such that the gap width is by an offset smaller than the setpoint cross section of the rolled wire or rod. In conjunction with thin setting, the pneumatic springs PF are slid into the receiving opening of the support body TK and secured in place with the clamping devices KL. The profile of the lowered wire or rod which enters the feed or guide gap opens this gap against the pressure of the pneumatic spring PF by an amount corresponding to the actual cross section. The pneumatic spring PF thus insures that the guide rollers FR1, FR2 are preset with a spring force as established in this pneumatic spring. This spring force is so dimensioned that the guide rollers FR1, FR2 bear upon the rolled wire or rod, independently of changes in the diameter of the rolled wire or rod segment traversing the guide, always with the same pressure. The spring force of the pneumatic spring PF is thus so dimensioned that the rolled wire or rod is reliably fed between the guide rollers FR1, FR2 but not rolled reduced in cross section thereby.

The invention claimed is:

1. A wire or rod guide between finishing mill stands of a wire or rod rolling line, said wire or rod guide comprising:

an elongated support body located between finishing mill stands of a wire or rod rolling line and traversed by a wire or rod being rolled in said stands;

a centering funnel at an upstream end of said support body with respect to a direction of movement of said wire or rod therethrough;

a pair of double-arm levers journaled in respective fulcrum bearings on said support body and each having a respective pivot arm extending downstream in said direction from the respective fulcrum bearing and a respective pivot arm extending upstream with respect to said direction from the respective fulcrum bearing, the pivot arms extending downstream having respective free ends;

respective opposing guide rollers journaled on said free ends and engaging said wire or rod from opposite sides;

setting elements on the pivot arms extending downstream and pressing against said support body for setting a spacing of said guide rollers; and an adjustable pneumatic pressure spring between one of said pivot arms extending upstream and said support body to apply an adjustable preset spring force to said rollers.

2. The wire or rod guide defined in claim 1 wherein said adjustable pneumatic pressure spring is connected to said one of said pivot arms extending upstream and bears on said body.

3. The wire or rod guide defined in claim 1 wherein said adjustable pneumatic pressure spring is connected to said body and bears on said one of said pivot arms extending upstream.

* * * * *